US011796271B1

(12) United States Patent
Kohli

(10) Patent No.: US 11,796,271 B1
(45) Date of Patent: Oct. 24, 2023

(54) FIRING PIN RELEASE SYSTEM

(71) Applicant: Florian Kohli, Geneva (CH)

(72) Inventor: Florian Kohli, Geneva (CH)

( * ) Notice: Subject to any disclaimer, the term of this patent is extended or adjusted under 35 U.S.C. 154(b) by 0 days.

(21) Appl. No.: 17/899,251

(22) Filed: Aug. 30, 2022

(51) Int. Cl.
*F41A 19/23* (2006.01)

(52) U.S. Cl.
CPC ..... *F41A 19/23* (2013.01)

(58) Field of Classification Search
CPC ..... F41A 19/18; F41A 19/21; F41A 19/22; F41A 19/23; F41A 19/68
USPC ..... 42/41; 89/126, 127, 1.41, 27.11
See application file for complete search history.

(56) References Cited

U.S. PATENT DOCUMENTS

| | | | | |
|---|---|---|---|---|
| 2,981,156 | A * | 4/1961 | Fletcher | F41F 1/08 89/127 |
| 4,207,795 | A * | 6/1980 | Reed | F41A 19/23 89/1.813 |
| 4,644,845 | A * | 2/1987 | Garehime, Jr. | F41G 3/14 89/1.41 |
| 2007/0240351 | A1 | 10/2007 | Maldonado Ferreira Lopes | |
| 2020/0158453 | A1 * | 5/2020 | Fitzgerald | F41A 9/36 |

FOREIGN PATENT DOCUMENTS

| | | |
|---|---|---|
| AT | 385 593 | 4/1988 |
| CN | 109141106 | 1/2019 |
| DE | 307117 | 7/1920 |
| IN | 34/2007 | 8/2007 |

OTHER PUBLICATIONS

VBBSMYT, "Reffy Mitrailleuse 1867," Sep. 10, 2010, https://youtu.be/jO3haWrRtrY, 62 pages.

* cited by examiner

*Primary Examiner* — Bret Hayes
(74) *Attorney, Agent, or Firm* — NIXON & VANDERHYE

(57) ABSTRACT

A firing pin release system, includes: a support; bores distributed about an axis at a first distance from the axis; firing pins each in a respective bore and movable at least parallel to the axis, each including a first extremity to strike a cartridge primer and a second extremity to be retained in a cocked position by a retaining system rotatably mounted on the support about the axis; firing pin springs each biasing a firing pin towards a fired position; a retaining system retaining the firing pins in a cocked position against the firing pin springs. The retaining system includes a rotatable ring carrying a first shoulder extending along a circle centered on the axis cooperating with the second extremity of each firing pin in the bores, retaining the firing pin cocked against the firing pin spring, the first shoulder including an opening passing the firing pins' second extremity.

11 Claims, 3 Drawing Sheets

FIRING PIN RELEASE SYSTEM

TECHNICAL FIELD

The present invention relates to firing pin release systems. More specifically, it relates to a rotary mechanism for releasing a plurality of firing pins according to a predefined sequence.

STATE OF THE ART

US7506467 relates to a rotating percussion handgun in which a cluster of barrels, each adapted to receive a cartridge, is positioned in front of a corresponding cluster of firing pins. A rotary mechanism is provided such that, when a safety device is released, the barrel cluster and firing pin cluster can be rotated with respect to a handle which, by means of a camming system, causes the withdrawal and release of each firing pin in turn. Such a double-action firing system makes it difficult to rotate the barrel cluster with respect to the handle, reducing the potential accuracy of the system. Furthermore, such an arrangement is only suitable for a limited number of firing sequences, typically firing one barrel after the other. In essence, a sequence requiring firing more than one barrel at a time massively increases the force required.

A similar arrangement is disclosed in CN109141106, intended to be mounted on an unmanned aerial vehicle and is hence motorized. Again, a double-action type system is used to withdraw and release each firing pin in turn, which requires a significant amount of motor torque.

The aim of the present invention is hence to provide a rotary firing pin release system for use in such, and other, roles, which is exempt from the above-mentioned drawbacks.

DISCLOSURE OF THE INVENTION

More precisely, the invention relates to a firing pin release system as defined in claim 1. This system comprises:

- a support;
- at least a first sequence of a plurality of bores distributed about an axis at a first distance from said axis;
- a plurality of firing pins each disposed in a respective bore and movable at least parallel to said axis, each firing pin comprising a first extremity adapted to strike a primer of a cartridge and a second extremity arranged to be retained in a cocked position by a retaining system rotatably mounted on said support about said axis;
- a plurality of firing pin springs each arranged to bias a respective firing pin towards a fired position;
- a retaining system adapted to retain said firing pins in a cocked position against the effect of said firing pin springs.

The retaining system comprises rotatable ring carrying a first shoulder extending along a circle centered on said axis and adapted to cooperate with the second extremity of each firing pin situated in said first sequence of bores, so as to retain said firing pin in its cocked position against the effect of the corresponding firing pin spring, said first shoulder comprising at least one opening (such as a notch) adapted to permit the passage of the second extremity of said firing pins.

As a result, the firing pin springs are pre-charged and held by the shoulder, and as a result these springs do not need to be (further) charged by rotation of the rotatable ring. As a result, significantly less force is required to operate the firing pin release system than in the "double-action" type arrangements of the prior art, since they simply slide on the shoulder and are released by the opening. Potential accuracy of the firearm or similar to which the system is attached is hence maximized. Furthermore, it is possible to provide multiple openings in the shoulder, permitting the release of multiple firing pins simultaneously.

Advantageously, the firing pin release system further comprises a second sequence of a plurality of bores distributed around said axis at a second distance from said axis which is different from said first distance, wherein said retaining system comprises a second shoulder extending along a circle centered on said axis and adapted to cooperate with the second extremity of each firing pin situated in said second sequence of bores so as to retain said firing pins in a cocked position against the effect of each corresponding firing pin spring, said second shoulder comprising at least one further opening (such as another notch) adapted to permit the passage of the second extremity of said firing pins.

In this arrangement, the number of firing pins which can be retained and released can be increased, enabling firing of cartridges in a greater number of barrels. Of course, more than two series of bores and firing pins can be provided if desired.

Advantageously, said second shoulder is carried by said rotatable ring, minimizing the number of parts required to carry both shoulders.

Advantageously, said at least one opening of said second shoulder is co-radial with said at least one opening of said first shoulder, considered with respect to said axis. In other words, the firing pin springs are radially aligned with each other. This facilitates manually setting the firing pins in their retained positions, and when said bores of said second sequence are angularly offset from said bores of said first sequence, ensures that the firing pins are released alternately from each sequence.

Advantageously, said rotatable ring is mounted on a slip ring interposed between the rotatable ring and the support. This slip ring may be made of e.g. polymer (such as PTFE), metal, or may be a ball bearing, and serves to reduce friction between the rotatable ring and the support.

Advantageously, said rotatable ring is rotatably retained on a first face of said support by a guide rod inserted into a second face of said support, said guide rod extending along said axis and said rotatable ring being directly or indirectly retained e.g. by a retention plate fixed to said guide rod and keyed to said rotatable ring. This keying may for instance be attained by said retention plate being situated in corresponding grooves or notches in the rotatable ring. Other arrangements are of course possible.

Advantageously, said second extremity of each of said firing pins situated in the bores of said first series comprises a groove arranged to cooperate with said first shoulder. The same can apply for the said firing pins situated in the bores of said second series. Simple, economical production is hence possible.

BRIEF DESCRIPTION OF THE DRAWINGS

Further details of the invention will become apparent from the description below, in reference to the figures in which.

EMBODIMENTS OF THE INVENTION

Figure 1:
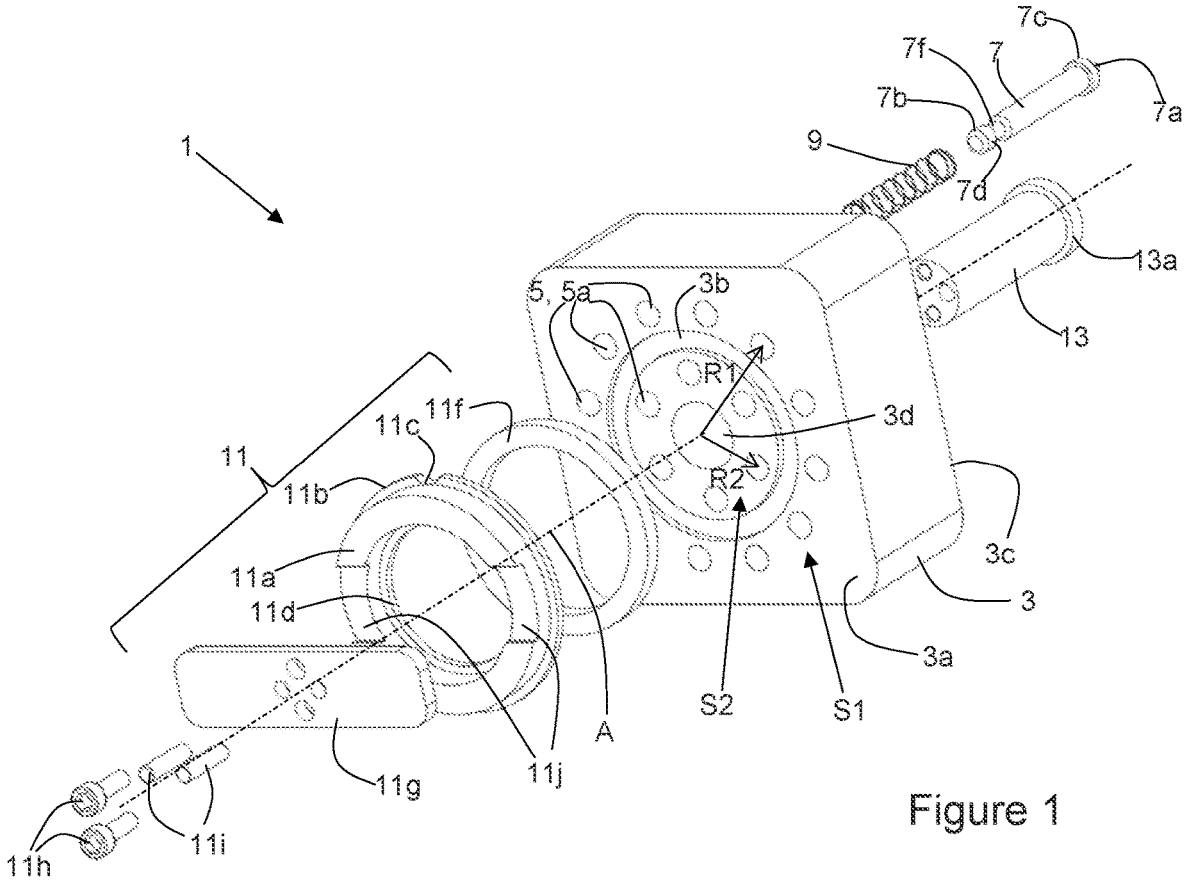
FIG. 1 is a schematic isometric exploded view of a firing pin release system according to a nonlimiting embodiment of the invention.
Figure 2:
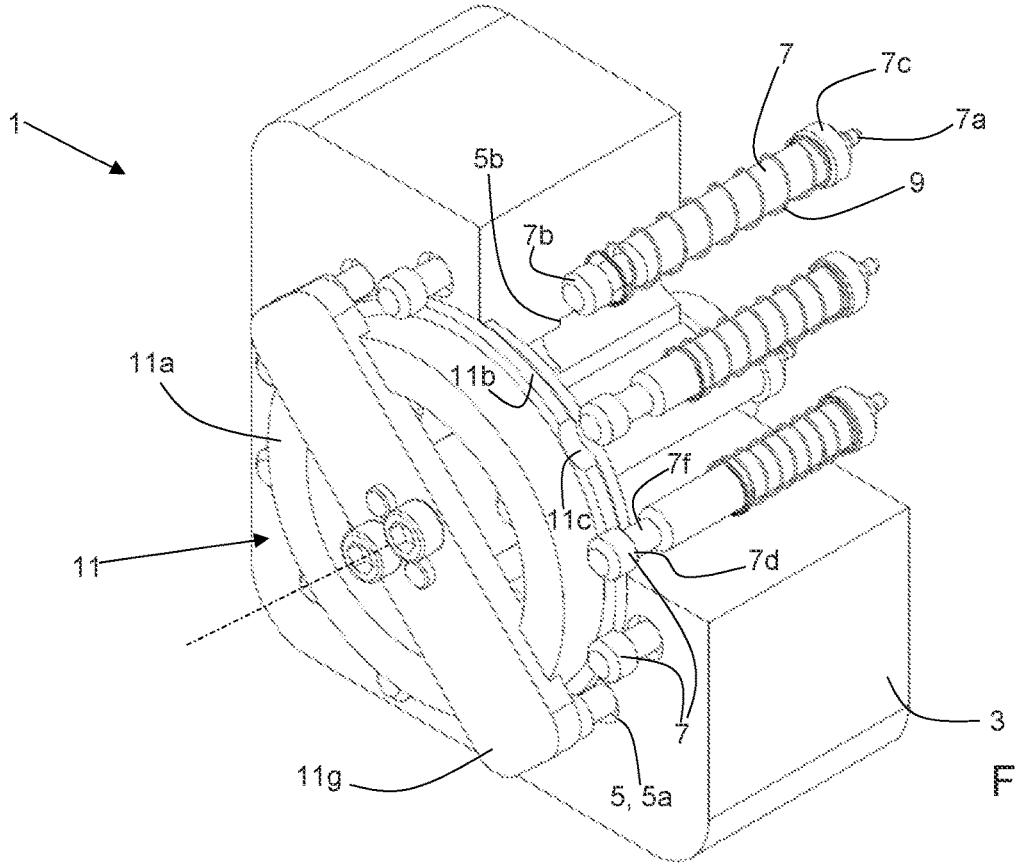
FIG. 2 is a schematic isometric cutaway view of the firing pin release system of FIG. 1, a quarter of the support having been cut away while leaving three firing pins still illustrated in the cutaway section.
Figure 3:
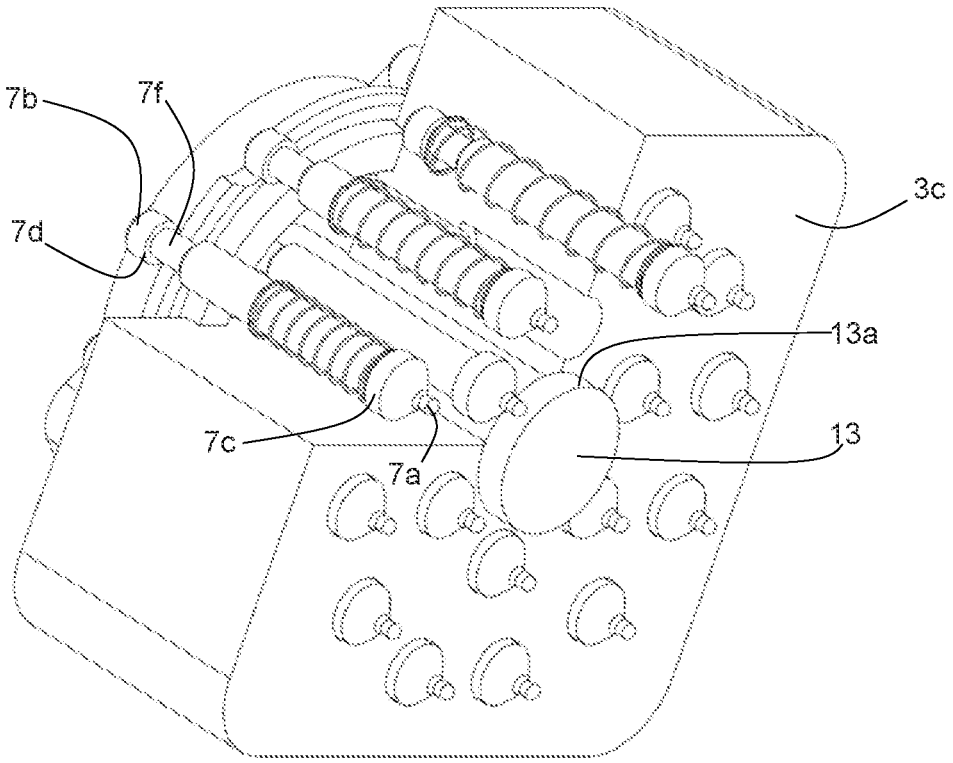
FIG. 3 is a view similar to that of FIG. 2, from a different angle.

FIGS. 1-3 illustrate schematically a firing pin release system 1 according to a nonlimiting embodiment of the invention. In order to avoid overloading the figures, limited reference signs have been used when multiples of the same element are illustrated.

This system 1 is intended to fire percussion cartridges 21 (see FIG. 4), whether centrefire or rimfire, these cartridges being e.g. small-arms cartridges, grenade cartridges, flare cartridges, air cartridges, gas cartridges, artillery cartridges or similar, held in a plurality of barrels 15*a* (see FIG. 4) to which the system 1 is attached.

The system 1 comprises a support 3 comprising a plurality of bores 5 each adapted to receive a corresponding firing pin 7, only one of which is illustrated on FIG. 1.

The bores 5 are arranged in two series, the bores 5 of the first series S1 being arranged with their respective centers at a first distance R1 from an axis A, and the bores 5 of the second series S2 being likewise arranged with their respective centers at a second distance R2 from the axis A, said second distance R2 being different from the first distance R1. The bores 5 of each series S1, S2 are evenly distributed around axis A, with those of each series angularly interleaved with respect to those of the other series. However, irregular distributions, one or more gaps in an otherwise regular distribution, and other configurations are also possible.

Each firing pin 7 extends parallel to the axis A, and comprises a first extremity 7*a* adapted to strike a primer of a cartridge 21. As illustrated, the first extremity 7*a* of the firing pin 7 is coaxial with the firing pin in order to actuate a centrefire primer. The opposite, second extremity 7*b* of each firing pin is configured to pass through an opening 5*a* in a first face 3*a* of the support 3.

In order to power the firing pins 7, each of these latter is provided with a corresponding firing pin spring 9 arranged around the corresponding firing pin 7 in the corresponding bore 5, and acting on a collar 7*c* situated proximate to the first extremity 7*a*. To this end, the openings 5*a* are configured so as to not permit the passage of the firing pin springs 9, leaving a shoulder 5*b* in each bore against which the spring pushes in order to propel the firing pin towards a fired position.

In order to retain the firing pins in a cocked position prior to their release, a retaining system 11 is provided. This retaining system 11 comprises a rotatable ring 11*a* carrying a first retaining shoulder 11*b* extending along a circle centered on axis A, and adapted to cooperate with the second extremity 7*b* of each firing pin 7 so as to retain this in a cocked position, in which the corresponding firing pin spring 9 is compressed.

To this end, a firing pin retaining shoulder 7*d* is provided proximate to the second extremity 7*b* of each firing pin 7. In the illustrated embodiment, this is formed by a groove 7*f* machined in the firing pins 7, however a radially-protruding rim or other configurations serving the same purpose are possible.

In the illustrated embodiment, first retaining shoulder 11*b* is configured so as to protrude into these grooves 7*f*, and thereby block the firing pins 7 in their cocked position.

In order to release the firing pins, the first retaining shoulder 11*b* comprises at least one notch 11*c* defining an opening adapted to permit the passage of the second extremity 7*b* of each firing pin 7. The middle firing pin 7 of the cutaway section is illustrated as being in the process of moving from its cocked position to its fired position, and the uppermost firing pin 7 in the cutaway section has moved fully into its fired position.

Presuming that all the firing pins 7 of the first series S1 are retained by the first retaining shoulder 11*b*, by rotating the rotatable ring 11*a* in either direction, the firing pins 7 will be released by the passage of the notch 11*c*, and will be propelled away from the ring 11*a* by their corresponding firing pin springs 9.

By providing multiple notches 11*c*, multiple firing pins 7 can be released at once, the number being chosen at will. Indeed, if the number of notches 11*c* is equal to the number of firing pins 7 in the first series S1, it is possible to release all the firing pins 7 of this series at once.

In the illustrated embodiment, a second series S2 of bores 5 is provided at the interior the first series S1, intercalated between the bores 5 of this latter. In order to retain the firing pins 7 of this second series S2, a second retention shoulder 11*d* is provided on the inside of rotatable ring 11*a*, configured similarly to the first retention shoulder 11*b*. The notch of the second retention shoulder, which constitutes a further opening, is not visible, and is radially aligned with the notch 11*c*, however this does not have to be the case, and the two notches can be angularly offset from one another as desired.

Of course, it is also possible to provide further series of bores 5 at different distances from the axis A, and corresponding retention shoulders provided on further rotatable rings in order to retain the firing 7 pins situated in the corresponding bores 5.

In order to mount the rotatable ring 11*a* on the support 3, in principle this can be achieved by any suitable means known to the skilled person. In the illustrated nonlimiting embodiment, a slip ring 11*f* is provided in an annular groove 3*b* provided in the first face 3*a* of the support 3. This slip ring 11*f* is for instance made of a self-lubricating polymer such as PTFE, but it may be made of other polymers, metal or similar. Alternatively, the slip ring 11*f* may be a ball bearing assembly. The rotatable ring 11*a* is in contact with the slip ring 11*f*, or receives part of the slip ring 11*f* in an annular groove therein, and in this latter case is hence guided in translation in a plane perpendicular to axis A.

In order to support the rotatable ring 11*a* on the slip ring 11*f* while permitting it to rotate with respect to the support 3 about axis A, a guide rod 13 is provided. This latter is inserted into the second face 3*c* of the support 3, which is opposite said first face 3*a* and parallel thereto, in an axial hole 3*d* extending along axis A. A flange 13*a* abuts against the second face 3*c* and prevents over-insertion of the guide rod 13, and a retention plate 11*g* is affixed to the end of the guide rod 13 closest to the first face 3*a*, e.g. by means of screws 11*h* and pins 11*i*. The retention plate 11*g* is keyed into notches 11*j* provided in the upper surface of the rotatable ring 11*a*.

As a result, rotating the retention plate 11*g*, e.g. by means of a motor, attached handle or similar (not illustrated on FIGS. 1-3) with respect to the support 3 causes the retention shoulders 11*b*, 11*d* to rotate and release the firing pins 7 in sequence as described above, hence firing the cartridges aligned with each firing pin 7 in the desired sequence.

The only resistance to the movement of the rotatable ring 11*a* is due to the friction in the system, since there are no springs that need to be charged by this rotation. The torque required is hence less than in the prior art, and is much more constant.

As can be seen from the figures, when the firing pins 7 are in a cocked position, they protrude from the second face 3*c* of the support 3, however this does not have to be the case.

In order to make the firing pin release system 1 ready, the firing pins 7 are inserted into their corresponding bores 5 via the second face 3*c* of the support 3 against the effect of the corresponding firing pin springs 9, the second extremities 7*b* of each firing pin 7 each being pushed in sequence through the corresponding opening 11*c* in the corresponding shoulder 11*b*, 11*d* and the rotatable ring 11*a* is rotated so as to cause the corresponding shoulder 11*b*, 11*d* to block said second extremities 7*b* in position with the firing pin springs 9 fully charged, i.e. compressed as much as they will ever be during operation. The system 1 can then be mounted to suitable barrels, as will be described below.

Figure 4:
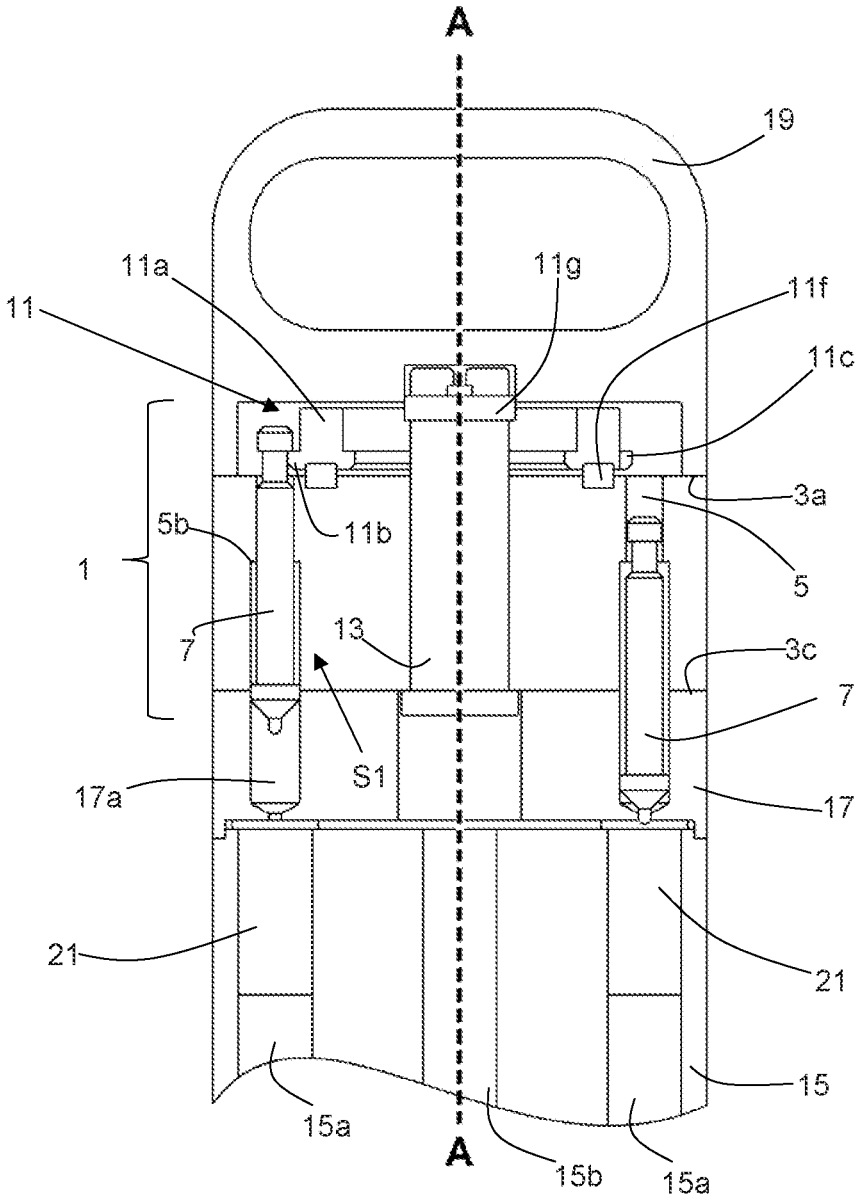
FIG. 4 is a simplified schematic longitudinal cross-sectional view of the firing pin release system of the invention mounted to a plurality of barrels.

FIG. 4 illustrates, in simplified cross-sectional form in a plane perpendicular to axis A, how the firing pin release system 1 of the invention comprising a single series S1 of bores 5 can be integrated with a barrel cluster 15. Of the two firing pins 7 visible on this figure, that on the left is in its cocked position, retained by the first shoulder 11*b*, and that on the right of the figure is aligned with the notch 11*c* in the first shoulder 11*b* and is in its fired position.

The barrel cluster 15 is rigidly mounted coaxially with the support 3 by any convenient means (such as one or more fixing bolts or other suitable means, not illustrated), and comprises a plurality of barrels 15*a* each aligned with a corresponding bore 5 and adapted to receive a cartridge 21 at its end situated proximate to the support 3. The barrel cluster 15 may be monobloc with the barrels being machined therein, or may comprise a plurality of individual barrels 15*a* joined together. Since the firing pins 7 protrude from the support 3 in the embodiment of FIGS. 1-3, an interface block 17 is provided, rigidly mounted between the support 3 and the barrel cluster 15 and comprises a plurality of communicating bores 17*a*, leading from the bores 5 to the barrels 15*a* to permit the firing pins 7 to travel under the effect of the firing pin springs 9 (not illustrated on FIG. 4) before hitting the primers of cartridges 21 situated in the barrels 15*a*.

In order to rotate the retention plate 11*g* and hence release the firing pins, a rotatable element 19 such as a grip, handle, lever, gear wheel or similar is provided on the first face 3*a* of the support, rotationally-fixed to the retention plate 11*g*. Rotating the rotatable element 19 with respect to the rigidly-assembled barrel cluster 15, interface block 17 and support 3 will cause the firing pins 7 to be released as described above. This rotation can be manual, or by means of an electric motor (not illustrated).

Barrel cluster 15 may also comprise a central hole 15*b*, which may optionally house a laser, a light or similar (not illustrated).

In terms of materials, the support 3, interface block 17 and barrel cluster 15 may be made of metal, polymer, reinforced polymer, metal-lined polymer, metal lined reinforced polymer, or any other suitable materials. The firing pins 7 are typically of metal, but other materials are also possible.

Although the invention has been described in terms of specific embodiments, variations thereto are possible without departing from the scope of protection as defined by the appended claims.

The invention claimed is:

1. A firing pin release system, comprising:

a support;

a first sequence of a plurality of bores distributed about an axis at a first distance from said axis;

a second sequence of a plurality of bores distributed around said axis at a second distance from said axis which is different from said first distance;

a plurality of firing pins each disposed in a respective bore and movable at least parallel to said axis, each firing pin comprising a first extremity adapted to strike a primer of a cartridge and a second extremity arranged to be retained in a cocked position by a retaining system rotatably mounted on said support about said axis; and a plurality of firing pin springs each arranged to bias a respective firing pin towards a fired position, the retaining system adapted to retain said firing pins in a cocked position against an effect of said firing pin springs, said retaining system including a rotatable ring carrying a first shoulder extending along a circle centered on said axis and adapted to cooperate with the second extremity of each firing pin situated in said first sequence of bores, so as to retain each firing pin in the cocked position against the effect of the corresponding firing pin spring, said first shoulder comprising at least one opening adapted to permit the passage of the second extremity of said firing pins, and said retaining system also including a second shoulder extending along a circle centered on said axis and adapted to cooperate with the second extremity of each firing pin situated in said second sequence of bores so as to retain said firing pins in the cocked position against the effect of each corresponding firing pin spring, said second shoulder comprising at least one further opening adapted to permit the passage of the second extremity of said firing pins.

2. The firing pin release system according to claim 1, wherein said second shoulder is carried by said rotatable ring.

3. The firing pin release system according to claim 1, wherein said at least one further opening of said second shoulder is co-radial with said at least one opening of said first shoulder.

4. The firing pin release system according to claim 3, wherein said bores of said second sequence are angularly offset from said bores of said first sequence.

5. The firing pin release system according to claim 1, wherein said rotatable ring is mounted on a slip ring interposed between the rotatable ring and the support.

6. The firing pin release system according to claim 1, wherein said rotatable ring is rotatably retained on a first face of said support by a guide rod inserted into a second face of said support, said guide rod extending along said axis and said rotatable ring being directly or indirectly fixed to said guide rod.

7. The firing pin release system according to claim 6, wherein said rotatable ring is retained by a retention plate fixed to said guide rod and keyed to said rotatable ring.

8. The firing pin release system according to claim 1, wherein said second extremity of each of said firing pins situated in the bores of said first sequence series comprises a groove arranged to cooperate with said first shoulder.

9. The firing pin release system according to claim 1, wherein said second extremity of each of said firing pins situated in the bores of said second sequence comprises a groove arranged to cooperate with said second shoulder.

10. A firing pin release system, comprising:

a support;

at least a first sequence of a plurality of bores distributed about an axis at a first distance from said axis;

a plurality of firing pins each disposed in a respective bore and movable at least parallel to said axis, each firing pin comprising a first extremity adapted to strike a primer of a cartridge and a second extremity arranged to be retained in a cocked position by a retaining system rotatably mounted on said support about said axis; and a plurality of firing pin springs each arranged to bias a respective firing pin towards a fired position, the retaining system adapted to retain said firing pins in a cocked position against an effect of said firing pin springs, said retaining system including a rotatable ring carrying a first shoulder extending along a circle centered on said axis and adapted to cooperate with the second extremity of each firing pin situated in said first sequence of bores, so as to retain each firing pin in the cocked position against the effect of the corresponding firing pin spring, said first shoulder comprising at least one opening adapted to permit the passage of the second extremity of said firing pins, wherein said rotatable ring is rotatably retained on a first face of said support by a guide rod inserted into a second face of said support, said guide rod extending along said axis and said rotatable ring being directly or indirectly fixed to said guide rod.

11. The firing pin release system according to claim 10, wherein said rotatable ring is retained by a retention plate fixed to said guide rod and keyed to said rotatable ring.

* * * * *